US005107905A

United States Patent [19]

Shaw et al.

[11] Patent Number: 5,107,905

[45] Date of Patent: Apr. 28, 1992

[54] PNEUMATIC DEVICE FOR CONVEYANCE OF WEFT THREAD TO A PREWINDER

[75] Inventors: Henry Shaw, Vleteren; Roger Ligneel, Beselare, both of Belgium

[73] Assignee: Picanol N.V., naamloze vennootschap, Belgium

[21] Appl. No.: 592,524

[22] Filed: Oct. 4, 1990

[30] Foreign Application Priority Data

Oct. 4, 1989 [BE] Belgium ..... 8901055

[51] Int. Cl.[5] ..... D03D 47/34

[52] U.S. Cl. ..... 139/450; 139/452

[58] Field of Search ..... 139/452, 450; 242/47.01, 35.6 E

[56] References Cited

U.S. PATENT DOCUMENTS 3,180,368 4/1965 Kobayashi .

4,969,489 11/1990 Tanaka et al. ..... 139/452

FOREIGN PATENT DOCUMENTS 269140 6/1988 European Pat. Off. .

1344809 10/1963 France .

57-77174 5/1982 Japan ..... 242/35.6 E

*Primary Examiner*—Andrew M. Falik

*Attorney, Agent, or Firm*—Bacon & Thomas

[57] ABSTRACT

A device for supplying weft threads in a weaving machine includes a bobbin support over which it is possible to slip a bobbin, a thread guide duct extending axially through the bobbin support and which includes an opening at the top for permitting entry of a yarn end into the thread guide duct, a blower for providing an airstram in the thread guide duct, the airstream flowing towards the top of the bobbin support, a prewinder, and a suction and blower device mounted at an entry of the prewinder. The blower and the suction and blower device are simultaneously switched on to create an airstream between the thread guide duct and the prewinder to carry the yarn end situated in the thread guide duct to the prewinder.

22 Claims, 6 Drawing Sheets

PNEUMATIC DEVICE FOR CONVEYANCE OF WEFT THREAD TO A PREWINDER

BACKGROUND OF THE INVENTION

This invention concerns a device for the supply of weft threads in weaving machines.

In particular, the invention concerns a device which allows the end of yarn of the weft thread of a bobbin to be automatically carried to the entry of a prewinder situated at some distance, without the intervention of complicated mechanisms being required to grip and convey this end of yarn.

SUMMARY OF THE INVENTION

To this aim, the present invention concerns a device for the supply of weft threads in weaving machines, including at least one bobbin support over which it is possible to slip a bobbin; a thread guide duct which extends axially through the bobbin support and which includes an opening at the top of the bobbin support permitting entry of an end of the yarn wound on the bobbin; blower means for providing an airstream in the thread guide duct, the air stream flowing towards the top of the bobbin support; a prewinder; a suction and blower device mounted at the entry of the prewinder; and means for simultaneously switching on the blower means and the suction and blower device to create an airstream between the thread guide duct and the prewinder to thereby carry the yarn end situated in the thread guide duct to the prewinder.

As the yarn end is blown towards the prewinder from a central position with respect to the bobbin, it will be conveyed very evenly and in the shape of a loop which itself will also unroll evenly. This offers the advantage that the weft thread will be carried to the desired place with great certainty.

In a preferred embodiment, an extra suction and blower device is mounted between the bobbin support and prewinder, in order to bridge the relatively large distances involved.

In order to assure an optimum guidance of the end of yarn which is moved by the airstream, guide plates for the airstream are preferably mounted at the entries of the suction and blower devices, made in the shape of flat discs having a central passage.

According to a preferred embodiment, the device is built such that the bobbin supports can be easily reached by the weaver, such that it is relatively easy to place a new bobbin, and such that the end of yarn can be sucked up relatively easily in the bobbin support.

BRIEF DESCRIPTION OF THE DRAWINGS

In order to better explain the characteristics of the invention, by way of example only and without being limitative in any way, the following preferred embodiments are described with reference to the accompanying drawings where.

DETAILED DESCRIPTION OF THE PREFERRED EMBODIMENT

Figure 1:
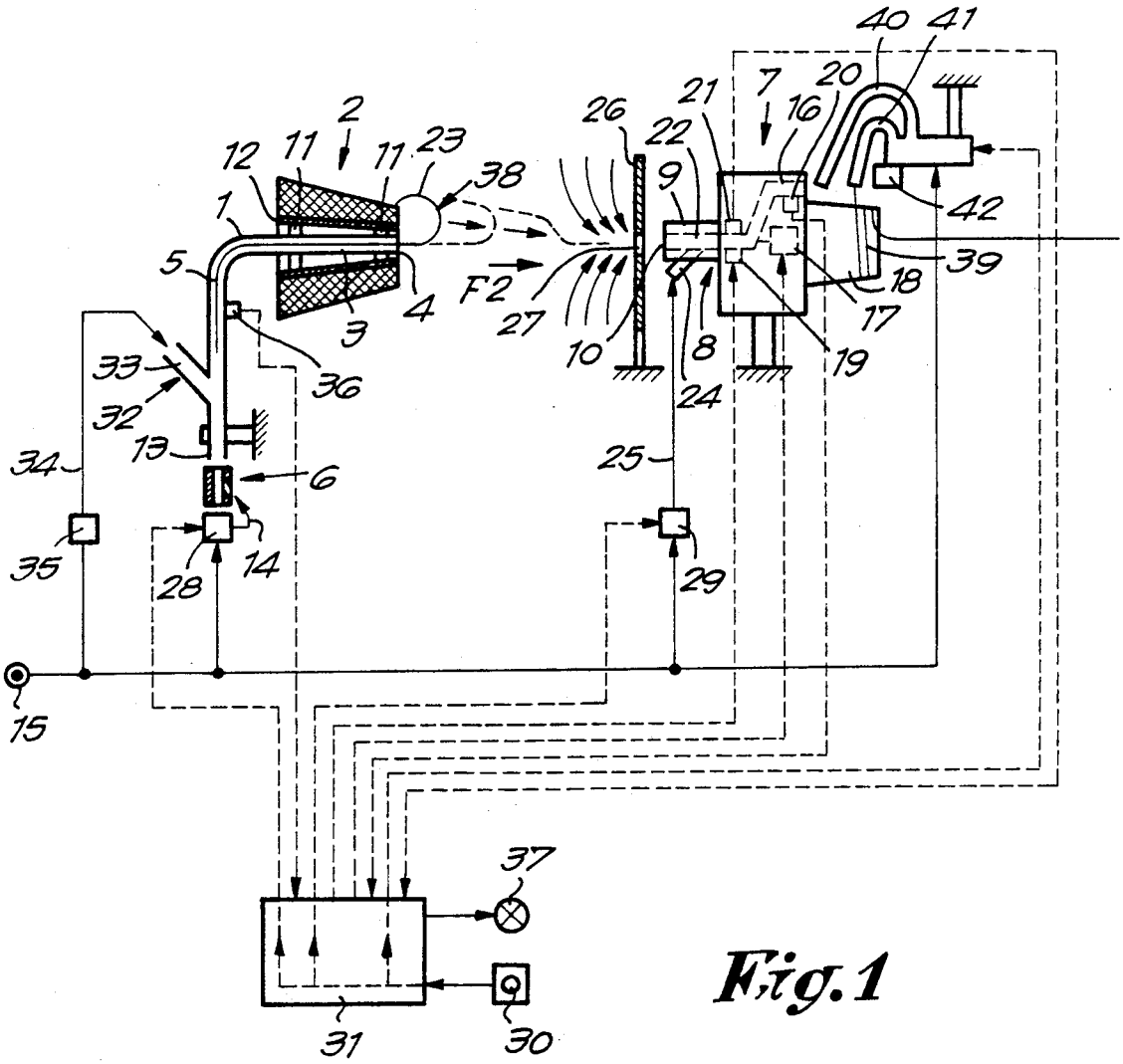
FIG. 1 is a schematic representation of the device according to the invention.

As indicated in FIG. 1, the device according to the invention includes at least one bobbin support 1 over which it is possible to slip a bobbin 2; a thread guide duct 3 which extends axially through the bobbin support 1 and which includes an opening at the top 4 of the bobbin support 1, permitting entry of an end of yarn 5 wound on bobbin 2; blower means 6 for providing an airstream in the thread guide duct, the airstream flowing towards the top 4 of the bobbin support; a prewinder 7 and a suction and blower device 9 mounted at the entry 8 of the prewinder 7. At the top 4, the exit of the thread guide duct 3 is directed precisely towards the entry 10 of the suction and blower device 9.

The bobbin support 1 is tube-shaped. A bobbin 2 is mounted on the bobbin support 1 by sliding it over the latter from the top 4, whereby the bobbin 2 is clamped in the known way by means of clamping elements 11 mounted on the bobbin support 1 and which work in conjunction with the sleeve 12 of the bobbin 2.

The above-mentioned blow means 6 which can work in conjunction with the thread guide duct 3 are in preference composed of a nozzle, provided at the far end 13 situated opposite the top 4, and connected onto a compressed air source 15 via a compressed air connection 14.

The prewinder 7 includes of, as is known, a winding tube 16 driven by means of a motor 17 on the one hand, and a fixed accumulator drum 18 on the other hand. The winding tube 16 may contain a thread brake 19, as well as a thread detector 20. In order to check the angular position of the winding tube 16, use can be made of an angle detector 21 or a similar device.

The above-mentioned suction and blower device 9 includes a jet nozzle formed by a continuous duct 22 for the guidance of a weft thread 23 and at least one duct 24 which communicates with duct 22 at a slanted or acute non-zero angle and which has been provided with a compressed air connection 25 to the compressed air source 15, such that, on the one hand, a sucking action is created at the entry 10, while, on the other hand, air is blown into the winding tube 16.

Figure 2:
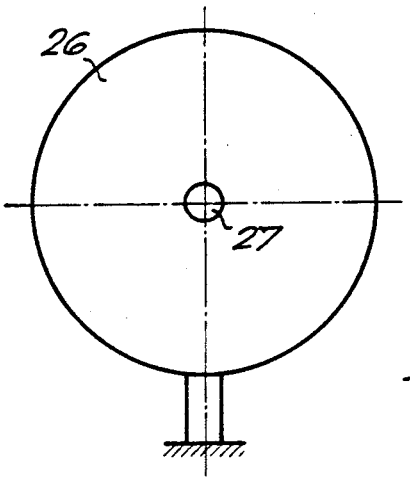
FIG. 2 shows a view according to arrow F2 in FIG. 1.

In preference, a guide plate 26 is mounted at the entry 10 of the suction and blower device 9 to guide the sucked-up air, such that an end of yarn 5 presented at the guide plate 26 automatically moves in the direction of the suction and blower device 9. The guide plate 26 preferably has a circle-shaped section in which a central opening 27 has been formed, as shown in FIG. 2.

The construction as a whole contains means which make it possible to simultaneously switch on the blower means 6 and the suction and blower device 9. In the embodiment according to FIG. 1, these are composed of electrically controlled, pneumatic valves 28 and 29, mounted in the compressed air connections 14 and 25, which are either opened by activating a push button 30, or which are automatically controlled by means of a control unit 31.

In preference, the device is also provided with suction means 32 which work in conjunction with the bobbin support 1, such that, at the top 4, the end of yarn 5 can be sucked up. These suction means 32 include, for example, at least one duct 33 ending an acute non-zero angle in the thread guide duct 3, which, by means of a compressed air connection 34, can be fed by the compressed air source via a mechanically operated valve 35.

The working of the device can be easily derived from FIG. 1. In case the previous bobbin 2 is empty, the weaver removes the empty sleeve 12 and places a new bobbin 2 on the bobbin support 1. Further, the working is analogous if the previous bobbin 2 is empty and a break occurs at the height of the bobbin 2 in question. The end of yarn 5 is presented either manually or automatically to the top 4 of the bobbin support 1, whereas the suction means 32 are activated by opening the valve 35. It is possible to check whether the end of yarn 5 is situated far enough in the thread guide duct 3 by means of a built-in thread detector 36 which may, for example, transmit a signal to an indicator 37 by means of the above-mentioned control unit 31.

Further, the blower means 6 and the suction and blower device 9 are excited simultaneously, either by activating the push button 30, or automatically by means of the control unit 31, such that the valves 28 and 29 open up. As a result of this, the end of yarn 5 is catapulted out of the thread guide duct 3 so to speak, to be conveyed by the suction and blowing action of the suction and blower device 9 into the winding tube 16. The arrival of the thread can be detected by means of the thread detector 20. Of course, care is taken, for example by means of the control unit 31, to put the thread brake 19, if provided, in an open position.

It is important to note that the end of yarn 5 is blown away from a central position with regard to the bobbin 2, because this offers the advantage that the relatively short loop 38 moves and unrolls very evenly, as a result of which the weft thread 23 will move in the direction of the prewinder 7 with great certainty.

After the end of yarn 5 has found its way to the winding tube 16, it can be further processed in various ways. For example, it is possible to connect this end of yarn to a thread remainder 39 on the accumulator drum 18. Although the further treatment of the ends of yarn 5 does not fall within the scope of the present invention, FIG. 1 shows a possibility in which the method and device known from U.S. Pat. No. 4,832,091 are applied. In that case, preliminary to the threading, the winding tube 16 is put in a particular position by means of the motor 17, the angle detector 21 and the control unit 31, such that the far end of the winding tube 16 is placed in front of a suction element 40 presented to the prewinder 7.

When the threading is executed, the end of yarn automatically finds its way to suction element 40. By means of a second suction element 41, the thread remainder 39 is taken up, after which the end of yarn 5, which stretches out into the second suction element 41 at that moment, is connected to the thread remainder 39 by means of a connecting device 42, such as a tying-in device or a tool to form a splice.

Figure 3:
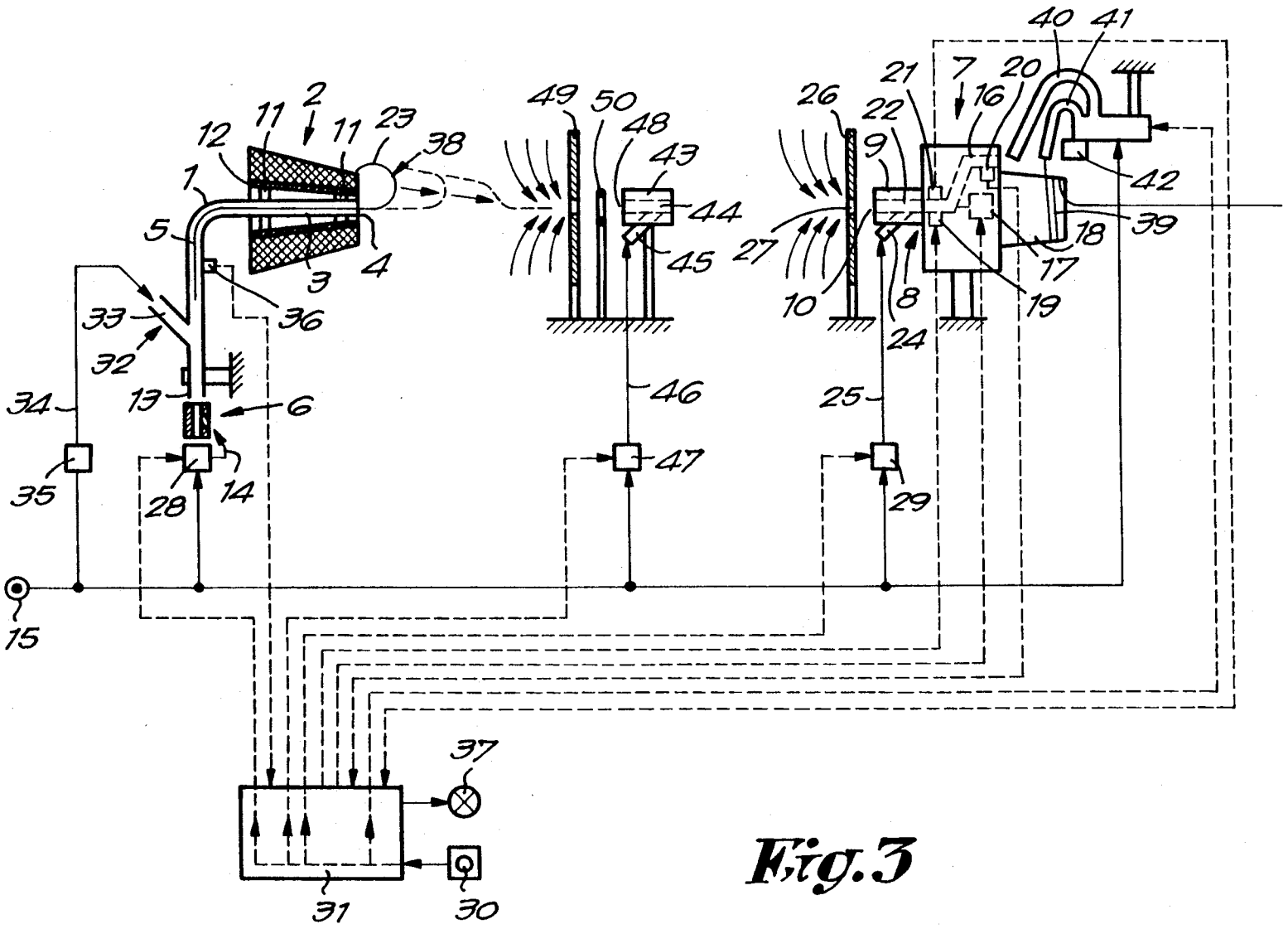
FIG. 3 shows a variant of the device according to the invention.

FIG. 3 shows a variant whereby an extra suction and blower device 43 has been mounted in between the bobbin support 1 and the prewinder 7. Device 43 is also composed of a continuous duct 44 and a duct 45 ending at an acute non-zero angle induct 44, whereby the latter has been provided with a compressed air connection 46 in which an electrically controlled valve 47 has been applied.

A guide plate 49, analogous to the guide plate 26, has been applied at the entry 48 of the suction and blower device 43, and possibly also a thread eye 50. Thus, entry 48 of suction and blower device 43 forms an extension of thread guide duct 3.

The working can be easily derived from FIG. 3. The main differences between the embodiment shown in FIG. 3 and that shown in FIG. 1 are distances can be bridged, and that, when the valves 28 and 29 are switched on, the valve 47 is also switched on.

Figure 4:
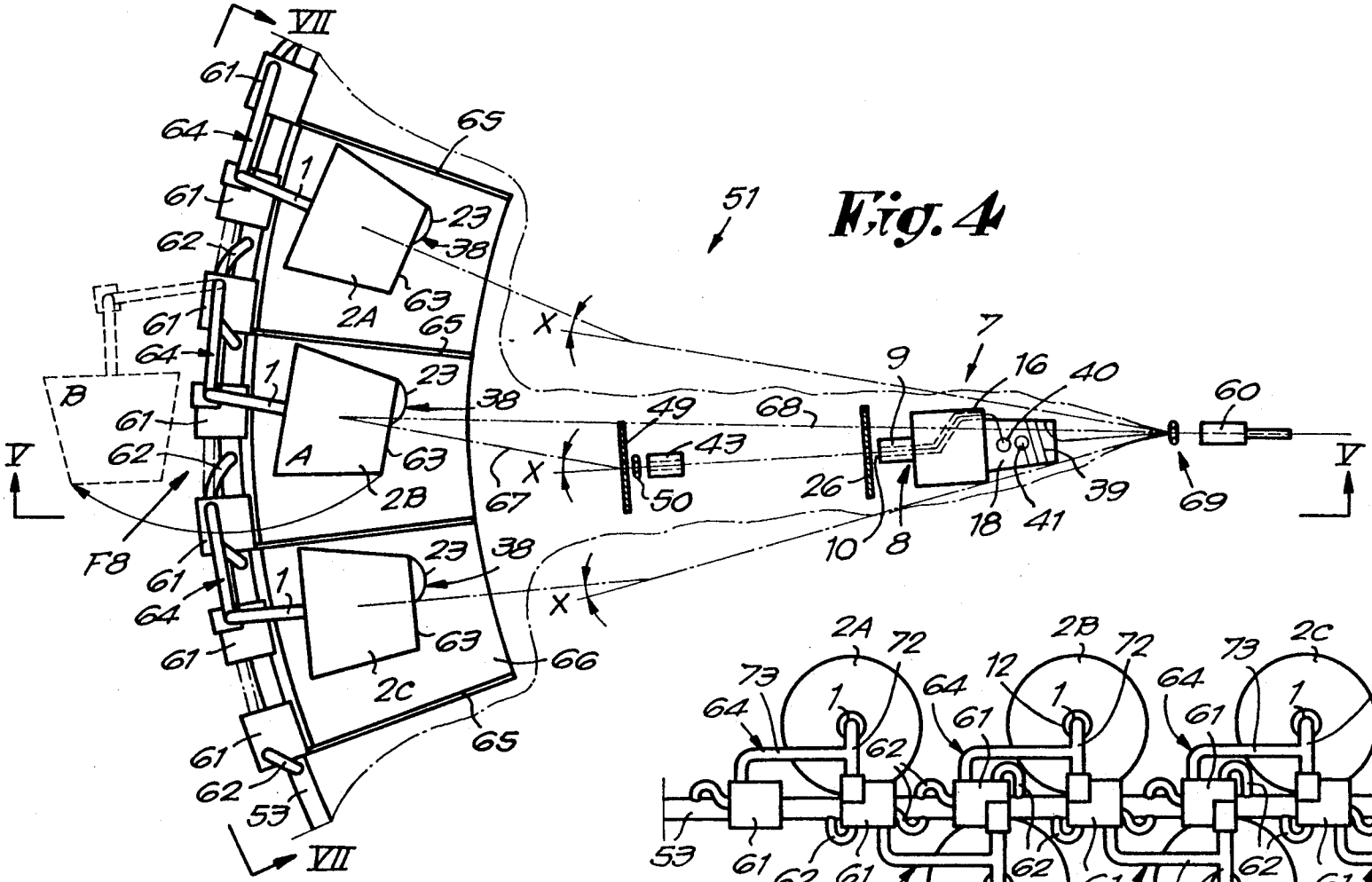
FIG. 4 shows a view from above of a practical embodiment according to the invention.
Figure 5:
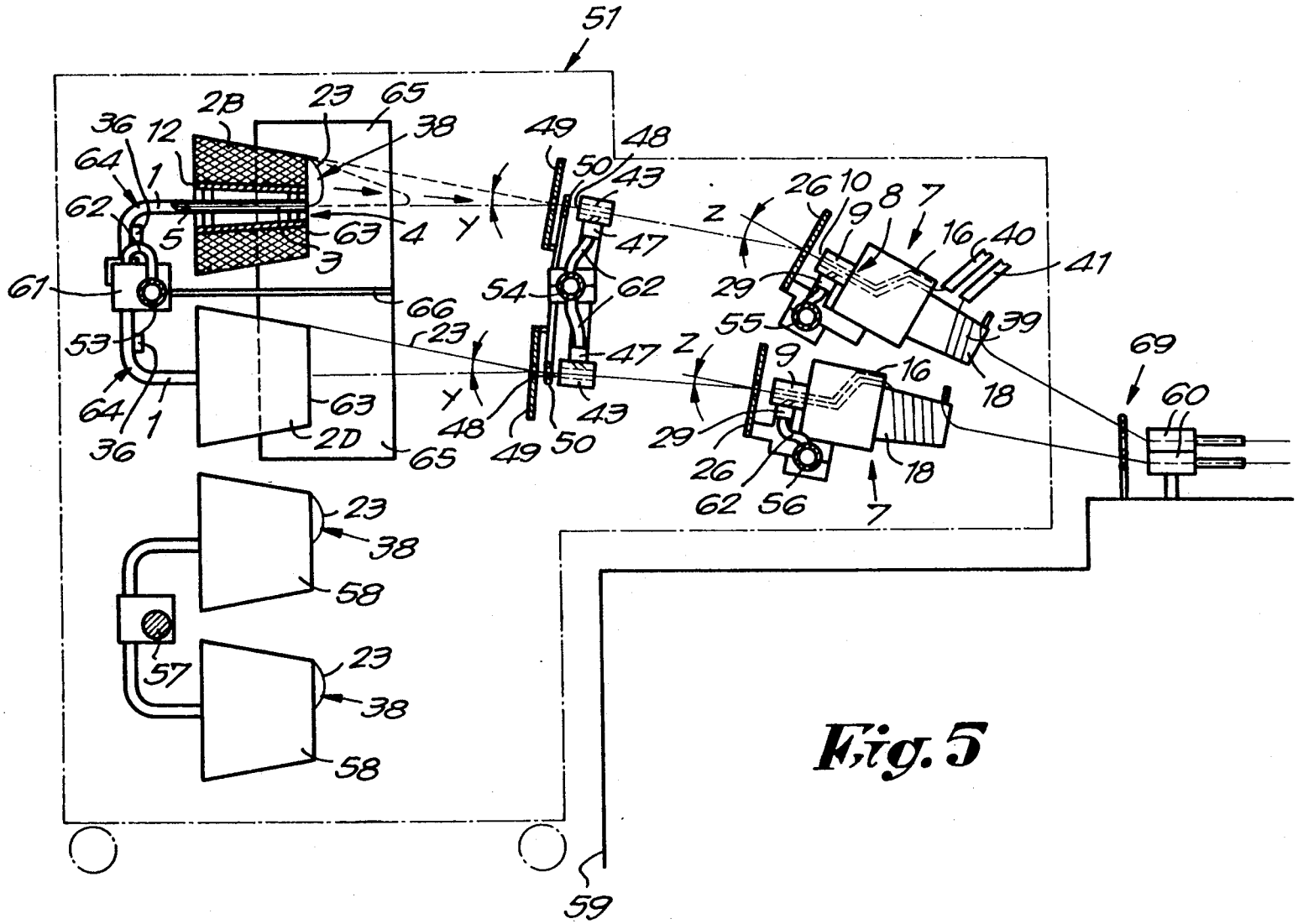
FIG. 5 is a cross-section according to line V—V in FIG. 4, whereby the frame of the device is represented only schematically for the sake of clarity.
Figure 6:
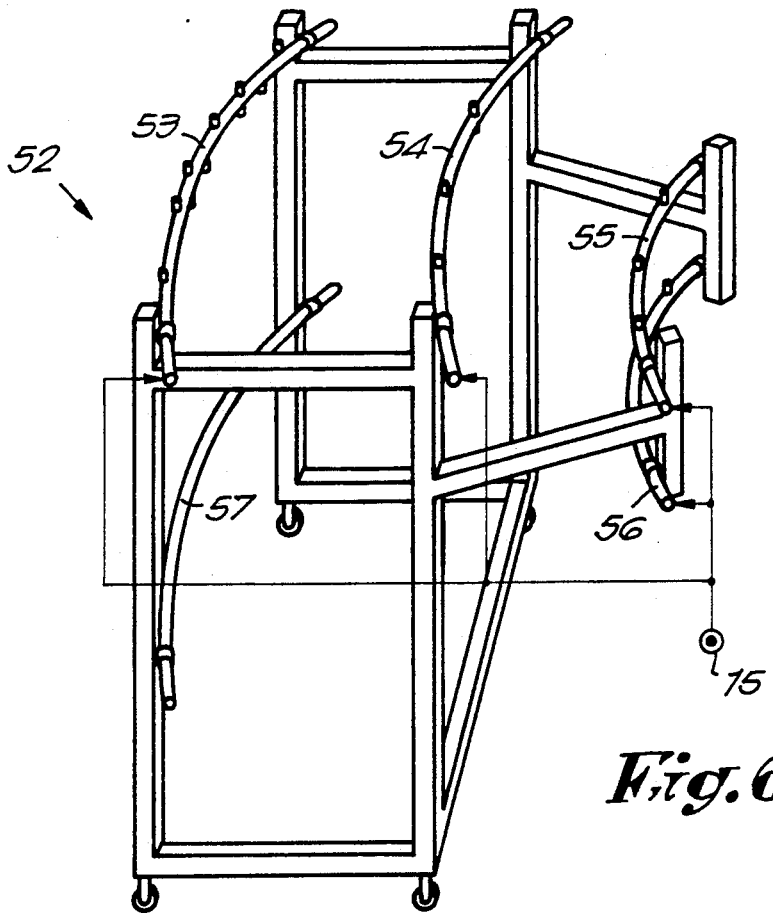
FIG. 6 shows a practical embodiment of the frame that can be used in the configuration according to FIG. 5.

FIGS. 4 and 5 show how, in the case where several yarn supply ducts have been provided for, the above-mentioned parts can be mounted and combined into, for example, a bobbin stand 51 on wheels, the frame 52 of which is represented separately in FIG. 6 for clarity's sake. Frame 52 has a number of supporting bars 53, 54 and 55–56 which, as shown in FIG. 5, are respectively designed for the mounting of the bobbin supports 1, the suction and blower devices 43 and the prewinders 7, as well as a supporting bar 57 upon which a number of bobbin supports have been mounted, upon which reserve thread bobbins 58 can be provided. Although, as indicated in FIG. 5 and the prewinders 7, the suction and blower devices 43 as well as the bobbin supports 1 form a separate bobbin stand 51, which can be partly presented over the weaving machine 59 such that the weft threads 23 find their way to the main nozzles 60, it is also possible, according to a variant, that one, several, or all of these parts are mounted fixedly onto the weaving machine 59.

The valves 28 and 35 are built-into junction pieces 61 mounted on the supporting bar 53. The valves 47 and 29 are situated immediately next to the suction and blower devices 9 and 43 in question, and are attached onto the supporting bars 54, 55 and 56. The supporting bars 53–56 are made hollow and are connected onto the compressed air source 15, as is schematically represented in FIG. 6. This makes it possible, as shown in FIG. 5, to supply all the above-mentioned valves with compressed air by means of very short pipes 62, which offers the advantage that pipes 62 cannot form any hindrance to the transport of the weft threads 23.

It is obvious that the control of the different parts is carried out as shown in FIG. 3. For clarity's sake, the connections to the control unit 31 are not shown in FIGS. 4 and 5.

Figure 7:
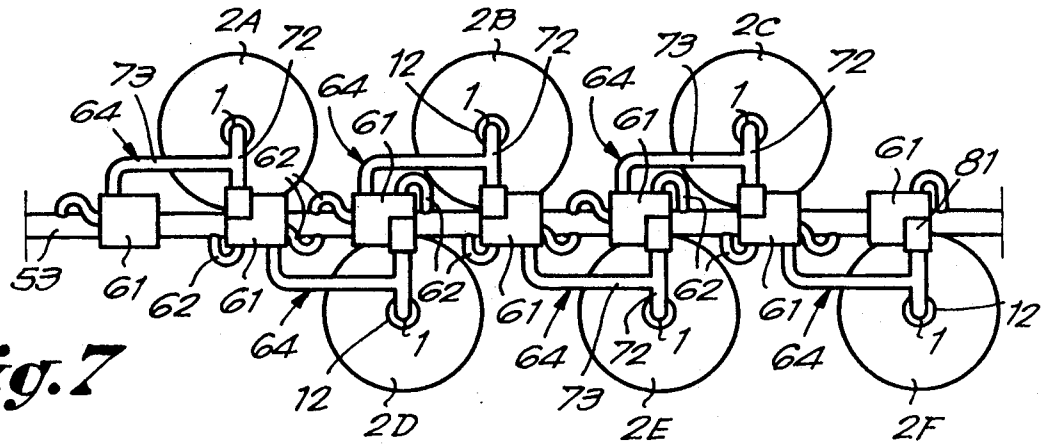
FIG. 7 shows a view according to line VII—VII in FIG. 4.

If several bobbins are used, these bobbins are in preference arranged according to a configuration as shown in FIG. 7, wherein the different bobbins have been separately marked with references 2A to 2F for clarity's sake. The bobbins are arranged in two rows, one situated on top of the other.

As shown in FIG. 5, the bobbin supports 1 are preferably mounted horizontally in order to avoid dust accumulation on the head faces 63 of the bobbins 2A–2F.

As shown in FIG. 4, the bobbin supports 1 are preferably moveable, such that the bobbins 2A-2F can be moved between a position A from which the weft thread 23 can be unspooled, and a position B in which the bobbin 2A-2F in question can be easily reached in order to place another bobbin or in order to present the end of yarn 5 to the top 4 of the bobbin support 1. In this position B, the end of yarn 23 is taken up in the bobbin support 1. In preference, the bobbin supports 1 are therefore part of rotatable stands 64 which, as shown in FIG. 7, are alternately situated above and under the junction pieces 61.

Vertical partitions 65 and horizontal partitions 66 have been applied in between the bobbins 2A-2F so as to avoid carriage of dust from one bobbin to the other, and so as to avoid too large a balloon formation during the unspooling. In order to keep the whole as compact as possible, and to nevertheless enable the bobbins 2A-2F to bemoved easily from their position A into position B, bobbin supports 1, as shown in the view from above, have been arranged according to a direction 67 at an angle with the connecting line 68 between the centre of the bobbin 2A-2F in question and the thread removal point 69 situated downstream to the prewinder 7, whereby the bobbin support 1 and the bobbin 2A-2F placed on it are closer to the one adjacent vertical partition 65 than to the other adjacent partition 65.

It is clear that a result of this arrangement of the bobbins 2 is that the weft threads 23 are merely bent over small angles X, Y and Z as they are carried to their thread removal point 69.

Figure 8:
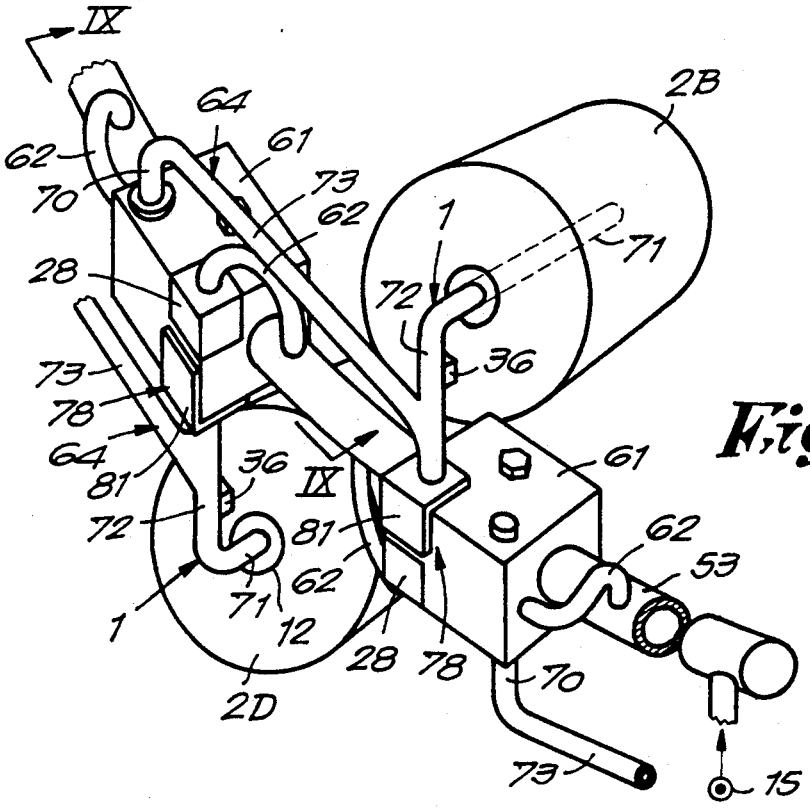
FIG. 8 shows a part of the device in perspective, in particular the part indicated in FIG. 4 by F8.

As shown in particular in FIG. 8, each stand 64, when viewed from above, is preferably L-shaped, whereby the stand 64 can be rotated at one far end of this L-shape into one of the above-mentioned junction pieces 61 by means of a vertical pivot 70. Each bobbin support 1 has a horizontal part 71 and a vertical part 72, whereby the vertical part 72 is connected to the pivot 70 by means of a horizontal arm 73. The bottommost end of the part 72 works in conjunction with a second junction piece 61 which is situated at a certain distance from the junction piece 61 in which the pivot 70 of the bobbin 2 in question is mounted.

Figure 9:
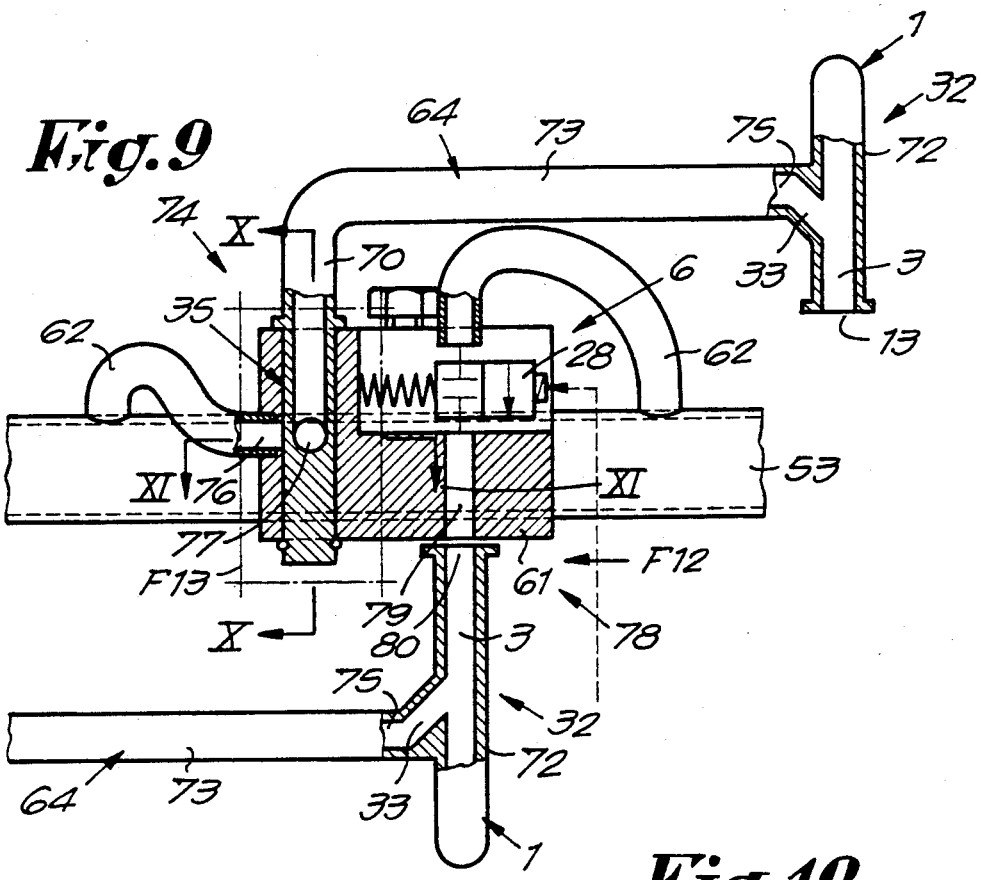
FIG. 9 is a cross-section according to line IX—IX in FIG. 8.
Figure 10:
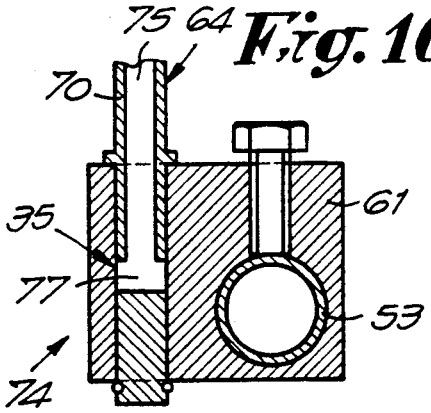
FIGS. 10 and 11 are cross-sections according to lines X—X and XI—XI respectively in FIG. 9.
Figure 11:
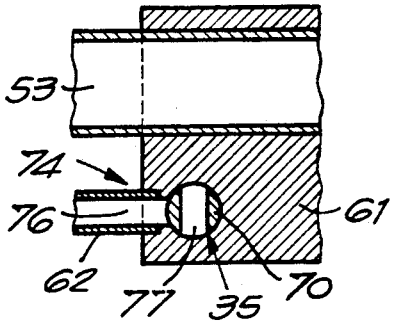

The whole has a first switches means 74 which switch on the suction means 32 when the bobbin support 1 in question is in position B. These switch means 74 are formed, as indicated in FIGS. 9 to 11, because the above-mentioned valve 35 has been built-into the pivot 70 and is therefore connected to the thread guide duct 3 via a duct 75 through the horizontal arm 73. The duct 75 ends slantways in the thread guide duct 3, such that blower air supplied via duct 75 can escape via the far end 13, as a result of which a suction movement is created at the top 4.

The valve 35 is formed by an entry 76 stretching radially out through the junction piece 61 with respect to the pivot 70, and a duct 77 coming out in the side wall of the pivot 70, in which the above-mentioned duct 75 comes out, such that in position A the situation is as shown in FIG. 11.

Further, the construction has second switch means 78 which prevent provision of a blower movement in the thread guide duct 3 as long as the bobbin support 1 in question is not in position A.

Figure 12:
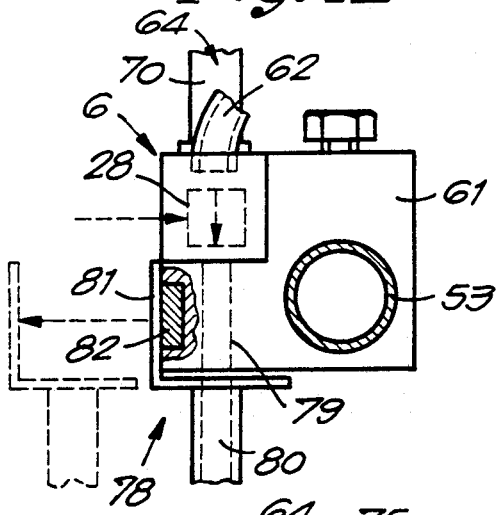
FIG. 12 shows a view according to arrow F12 in FIG. 9.

As shown in FIGS. 9 and 12, these second switch means 78 are preferably made up of a fixed exit 79 for the compressed air, connected to the valve 28 and an entry 80, communicating with the thread guide duct 3, in particular with the far end of the part 72, which, in position A, is situated opposite the exit 79.

Figure 13:
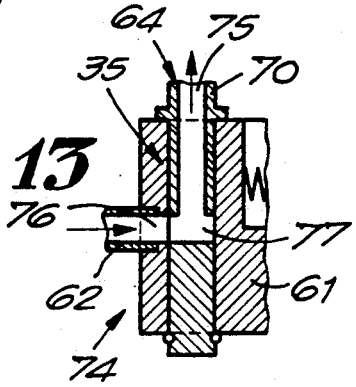
FIG. 13 shows the part indicated in FIG. 9 by F13, but for another position.

The stand 64 is equipped with a stop 81 which makes contact with a side wall of junction piece 61, and which can possibly be held against it by means of a permanent magnet 82 or another locking mechanism. When the stand 64 is turned back, the entry 80 moves away from the exit 79 and the above-mentioned valve 35 finally moves into a position as indicated in FIG. 13. From that moment on, compressed air is blown through the duct 75 to the far end 13, such that a suction movement is created at the top 4. A yarn supplied by the weaver at the top 4 of the bobbin support will then also be sucked up automatically, indicator 37 lighting up as soon as the yarn reaches the thread detector 36. Consequently, the stand 64 rotates back into position A, after which the above-mentioned valves, required for the conveyance of the yarn into the prewinder 7, can be excited.

The present invention is in no way limited to the embodiments described by way of example and shown in the accompanying drawings; on the contrary, such a device for the supply of weft threads in weaving machines can be made in various forms while still remaining within the scope of the invention.

We claim:

1. A weft thread supply device for a weaving machines, comprising means including a bobbin support for supporting a yarn bobbin; a thread guide duct which extends through the bobbin support and which includes means defining an opening at a top of the bobbin support for permitting entry of an end of said yarn into the thread guide duct; blower means for providing an airstream in said thread guide duct, said airstream flowing toward the top of the bobbin support and through said opening; a prewinder; a suction and blower device mounted at an entry of the prewinder; means for simultaneously switching on said blower means and said suction and blower device to create an airstream between said thread guide duct and said prewinder and thereby to carry a yarn end situated in the thread guide duct to the prewinder; means for causing said thread end to enter said opening; means for supporting the bobbin support for movement between a first position in which a yarn end situated in the thread guide duct can be carried to the prewinder by means of said suction and blower device and in which the bobbin can be unspooled and a second position in which a yarn end presented at the top of the bobbin support is caused to enter said thread guide duct; and first switch means for automatically actuating said means for causing said thread end to enter said opening when the bobbin support is moved into said second position.

2. A device as claimed in claim 1, wherein a portion of the thread guide duct located adjacent the top of the bobbin support is directed towards an entry of said suction and blower device.

3. A device as claimed in claim 1, wherein said means for simultaneously switching on said blower means and said suction and blower device includes valves connected to a compressed air source and means including a common push button for operating said valves.

4. A device as claimed in claim 1, further comprising an intermediate suction and blower device positioned between the bobbin support and the prewinder.

5. A device as claimed in claim 4, wherein an entry of the intermediate suction and blower device forms an extension of said thread guide duct.

6. A device as claimed in claim 4, wherein an entry of the first suction and blower device forms an extension of an exit of the intermediate suction and blower device.

7. A device as claimed in claim 4, further comprising means for switching on said intermediate suction and blower device simultaneously with the simultaneous switching on of said blower means and said first suction and blower device.

8. A device as claimed in claim 7, wherein said means for simultaneously switching on said blower means, said first suction and blower device, and said intermediate suction and blower device includes valves connected to a compressed air source and means including a common push button for operating said valves.

9. A device as claimed in claim 4, further comprising an entry in a front side of the intermediate suction and blower device and a guide plate mounted immediately in front of said entry of the intermediate suction and blower device.

10. A device as claimed in claim 9, wherein said guide plate mounted in front of the intermediate suction and blower device comprises a flat, circular plate with a central opening.

11. A device as claimed in claim 10, wherein said guide plate comprises a flat, circular plate with a central opening.

12. A device as claimed in claim 1, wherein said suction and blower device includes an entry in a front side thereof, and further comprising a guide plate mounted in front of the said entry of the suction and blower device.

13. A device as claimed in claim 1, further comprising second switch means for preventing the blower means from providing an airstream in the thread guide duct when the bobbin support is not in said first position.

14. A device as claimed in claim 1, wherein said means for supporting the bobbin support for movement between said first and second positions includes means for defining a pivot about which the bobbin support rotates, and wherein the first switch means comprises a side duct including means defining an opening in a side wall of the pivot, entry means connected to a compressed air source for defining an opening which communicates with said side wall opening when said pivot is in said second position, and means including a second duct which together with the first duct forms a connection with the thread guide duct for ensuring that the first duct can only be moved out of its normal position opposite the entry to the side wall of the pivot by moving the bobbin support from said second to said first position, and wherein said second duct extends at a non-angle in respect to the thread guide duct to thereby create suction at the top of the bobbin support.

15. A device as claimed in claim 1, further comprising a second switch means for preventing operation of the blower means when the bobbin support is moved from said first position, said second switch means comprising a fixed exit for the compressed air, an entry communicating with the thread guide duct, and means for causing said entry to be situated opposite the exit when said bobbin support is in said first position and, when the bobbin support is moved to said second position, to be situated next to said exit, said device further comprising means including a stop for permitting exact positioning of the exit in respect to the entry.

16. A device as claimed in claim 15, wherein the device comprises a plurality of bobbin supports positioned in at least two rows situated one on top of the other, and junction pieces into which a plurality of said first and second switch means are built, each junction piece including one first and one second switch means, the junction pieces being positioned at predetermined distances from each other, and each bobbin support being part of an L-shaped stand; and further comprising means including a pivot in a junction piece for permitting the L-shaped stand to rotate in a horizontal plane, said L-shaped stand contacting an adjacent junction piece when said bobbin support is in said first position such that, for each bobbin support, one of said first switch means is situated in the junction piece in which a corresponding pivot is placed and one of said second switch means is situated in an adjacent junction piece.

17. A device as claimed in claim 16, wherein said rotatable stands are alternately situated above and below respective junction pieces.

18. A device as claimed in claim 1, further comprising means including a thread detector in the thread guide duct for checking the presence of a sucked-up yarn end.

19. A device as claimed in claim 1, further comprising means including pipes for supplying compressed air to the blower means and to said suction and blower device, said pipes being connected to hollow supporting bars which communicate with a compressed air source.

20. A device as claimed in claim 1, wherein said bobbin support is positioned precisely within a horizontal plane.

21. A device as claimed in claim 1, comprising a plurality of bobbin supports and further comprising partitions mounted in between respective bobbin supports and bobbins placed upon the bobbin supports.

22. A device as claimed in claim 1, wherein said means for causing said thread end to enter said opening comprise suction means for providing a suction to cause said thread end to enter said opening.

* * * * *